United States Patent [19]

Giachino et al.

[11] Patent Number: 4,477,245

[45] Date of Patent: Oct. 16, 1984

[54] FLAME MONITORING SAFETY, ENERGY AND FUEL CONSERVATION SYSTEM

[75] Inventors: Joseph M. Giachino, Farmington Hills, Mich.; Marion A. Keyes, IV, Chagrin Falls, Ohio

[73] Assignee: The Babcock & Wilcox Company, New Orleans, La.

[21] Appl. No.: 414,697

[22] Filed: Sep. 3, 1982

[51] Int. Cl.[3] ..... F23N 5/00

[52] U.S. Cl. ..... 431/78; 431/79; 431/75; 431/12

[58] Field of Search ..... 431/78, 79, 75, 12; 236/15 BD

[56] References Cited

U.S. PATENT DOCUMENTS

| | | | |
|---|---|---|---|
| 2,352,143 | 6/1944 | Wills | 431/12 |
| 2,386,807 | 10/1945 | Leslie | 431/78 |
| 2,460,314 | 2/1949 | Thomson | 431/79 |
| 2,767,783 | 9/1952 | Rowell et al. | 431/78 |
| 2,979,125 | 4/1961 | Katorsky | 431/79 |
| 3,193,199 | 7/1965 | Fuhs | 236/15 BD |
| 3,233,650 | 2/1966 | Cleall | 431/1 |
| 3,292,855 | 12/1966 | Wright | 431/12 |
| 3,586,468 | 6/1971 | Sims | 431/1 |
| 3,689,773 | 9/1972 | Wheeler | 431/79 |
| 4,243,372 | 1/1981 | Cade | 431/78 |

FOREIGN PATENT DOCUMENTS

| | | | |
|---|---|---|---|
| 626317 | 8/1978 | U.S.S.R. | 431/78 |

*Primary Examiner*—James C. Yeung
*Assistant Examiner*—Helen Ann Odar
*Attorney, Agent, or Firm*—Vytas R. Matas; Robert J. Edwards

[57] ABSTRACT

A flame monitor for a burner comprises an oscillator which generates a signal at a characteristic frequency, a flame modulator connected to the oscillator and the burner for modulating the flame which produces an electromagnetic signal at the same frequency and a signal detector for detecting the electromagnetic signal. A bandpass filter is connected to the detector for passing only the signal at the characteristic frequency. Circuitry is provided for detecting the intensity of the electromagnetic signal which is proportional to the flame temperature and which can be used to control the fuel or air supplied to the burner and thus optimize the flame. A single detector can be used to detect the flame from various burners where each burner is supplied with its own characteristic frequency and the detector is multiplexed to share its operation over the various burners. A pressure wave detector is also provided to detect the intensity of a pressure wave in the flame which is divided into the electromagnetic radiation intensity to provide a calibration signal.

8 Claims, 7 Drawing Figures

FLAME MONITORING SAFETY, ENERGY AND FUEL CONSERVATION SYSTEM

FIELD AND BACKGROUND OF THE INVENTION

The present invention relates, in general, to flamon devices and, in particular, to a new and useful device and method of determining a flame-on condition and for optimizing the efficiency and safety of the burner used to generate the flame.

Devices are known which remotely sense whether a flame from a burner is on or off. One such device disclosed in U.S. Pat. No. 3,586,468 to Sims discloses the use of an electromagnetic antenna provided in the vicinity of a flame. Flames are known to naturally generate electromagnetic waves which, according to the Sims patent, are picked up by the antenna. Sims provides an ultrasonic signal to the burner to artifically produce variations in the flame at a characteristic frequency.

According to U.S. Pat. No. 3,233,650 to Cleall, different compression-rarefaction wave frequencies can be utilized for different burners to provide each burner with a separate characteristic that can be detected to indicate which of the burners are producing a flame and which are not.

Other relevant patents in understanding the present invention are U.S. Pat. No. 2,979,125 to Katorsky and 2,460,314 to Thompson.

SUMMARY OF THE INVENTION

The present invention is drawn to a flame-on detection arrangement which modulates either the atomizing fluid or fuel flow to a burner to artificially impress a particular frequency to the electromagnetic radiation generated by the flame. The radiation is detected by the antenna or electrodes, filtered by a digital filter sensitive to the particular frequency and otherwise processed to sense whether a flame is present and also to optimize the condition of the flame by varying either the fuel flow or atomizing fluid flow to maximize the signal.

Any fluid medium, whether liquid or gas that contains atoms or molecules that have been ionized can act as a medium that converts ultrasonic energy into electromagnetic energy. This phenomenon was demonstrated by utilizing a 5% salt solution which inherently includes ions. This solution was ultrasonically modulated and the electromagnetic radiation sensed to be present. Without the presence of salt, and the accompanying ions, distilled water did not produce electromagnetic radiation. This phenomenon is utilized in the present invention.

According to the present invention, each flame is "tuned" to a particular characteristic frequency by ultrasonically modulating either the atomizing air or steam flow, or the fuel flow to the burner. This ultrasonic modulation is converted to an electromagnetic wave having the same frequency which is detected using electrodes or an antenna in the vicinity of the flame. A plurality of burners can be serviced by a single detector by applying a separate characteristic frequency to each burner and sharing the detector among the burners by using multiplexing techniques.

Using the insight that a maximization of electromagnetic radiation corresponds to a flame being generated at maximum efficiency, and electromagnetic signal can be maximized by selectively varying either the atomizing fluid or fuel flow rates. For start-up and shut-down operations of the burner or burners a flame-on indication, which senses the presence of a pilot light and a start-up request must be simultaneously received to permit the institution of a start-up sequence. For shut-down, either the start-up request is absent or the flame-on indication is absent to permit shut-down.

The invention can also be utilized to obtain a value which is independent of burner source strength, which value provides an absolute calibration versus a relative calibration measurement of flame temperatures. According to the invention, an electromagnetic detector as well as a compression-rarefaction wave detector in the form of a piezo-electric detector are utilized to generate two separate signals which are compared for strength or intensity.

Accordingly, an object of the present invention is to provide a flame monitor for a burner comprising, an oscillator for generating a characteristic frequency, flame modulation means connected to the burner and oscillator for modulating the flame at the characteristic frequency to produce an electromagnetic signal at the characteristic frequency, an electromagnetic signal detector associated with the burner for sensing the electromagnetic radiation of the flame, an electronic band-pass filter for passing the characteristic frequency connected to the detector for generating a flamon indication signal which increases with increased temperature in the flame, and level detection means connected to the filter for determining a level of the electromagnetic radiation of the flame.

A further object of the invention is to provide such a flame monitor wherein a plurality of burners are provided each with its own oscillator. A single detector is utilized to sense the presence of flames for all the burners which detector is shared in time among the burners and their oscillators.

Another object of the invention is to provide such monitoring wherein the amount of fuel or air is controlled by the level detecting means, the filter comprising a digital filter and the level detection means comprising a pair of sample and hold circuits connected to an analog output of the digital filter, a comparator connected to the sample and hold circuits, each of the sample and hold circuits controlled to sample separate parts of the electromagnetic signal separated by time by a sample control, an exclusive OR gate connected to the output of the comparator and an output of the sample control and an integrator connected to the output of the exclusive OR, gate whereby the fuel or air flow are controlled to optimize the electromagnetic signals and thus the flame temperature.

A still further object of the invention is to provide such a monitoring arrangement wherein a pressure wave detector is provided in the vicinity of the flame for generating a signal which varies at the characteristic frequency. In accordance with pressure waves in the flame, circuit means are provided for comparing the intensity of the electromagnetic wave with the pressure wave. The ratio of these two intensities being proportional to a calibration value for the burner.

For an understanding of the principles of the invention, reference is made to the following descriptions of typical embodiments as illustrated in the accompanying drawings.

DESCRIPTION OF THE PREFERRED EMBODIMENTS

Figure 1:
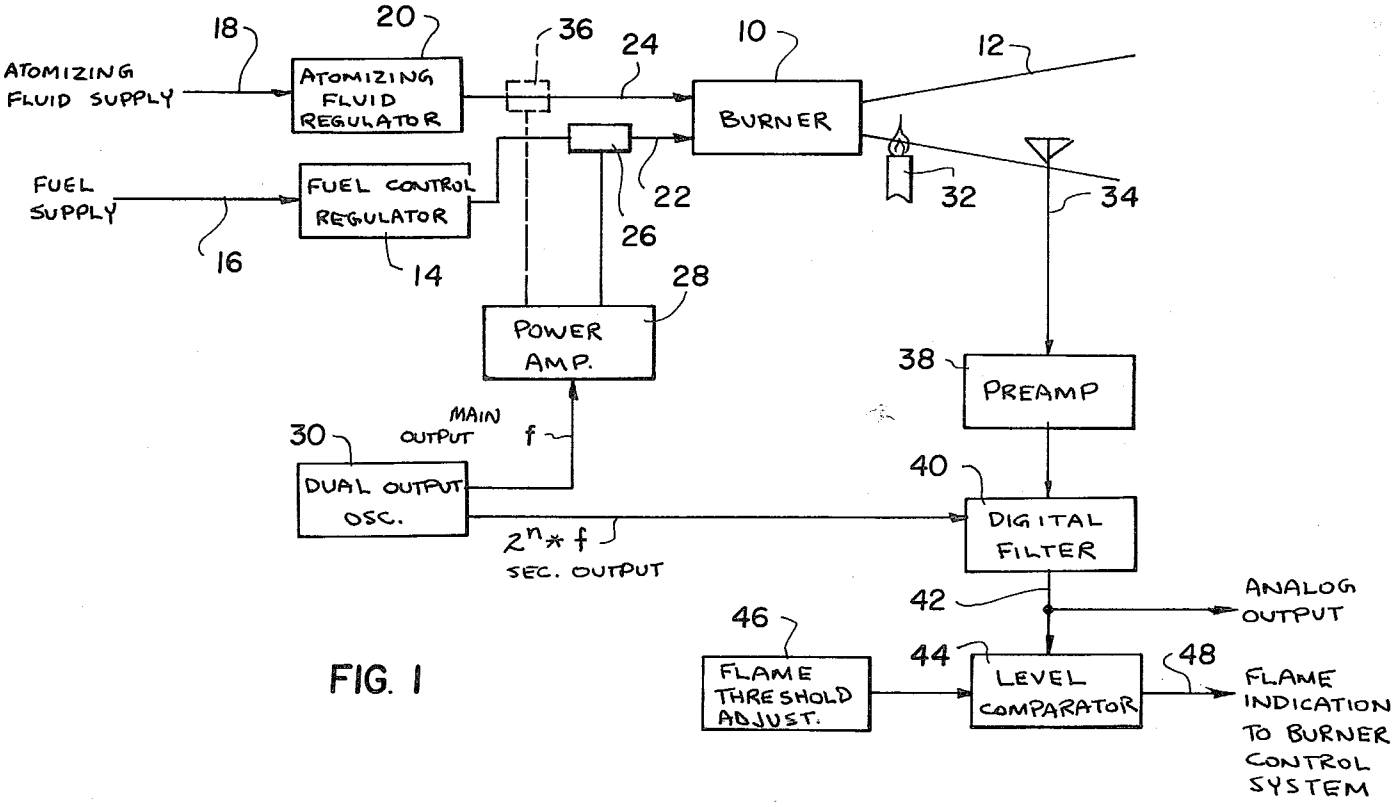
FIG. 1 is a block diagram showing the arrangement for a flame monitoring device according to the invention.

Referring to the drawings and the invention embodied there in FIG. 1 comprises a flame monitoring device for a burner 10 which produces a flame 12. Burner 10 is of the type which is fueled by oil or gas provided by a fuel control regulator 14 supplied with fuel over a line 16. Atomizing fluid such as air is provided over line 18 and atomizing fluid regulator 20. Fuel and air are provided over line 22, 24 to burner 10. According to one embodiment of the invention, an exciting transducer 26 is provided in the fuel line 22 to modulate the supply of fuel to the burner. Modulation is achieved over a power amplifier 28 which is supplied with the characteristic frequency by a dual output oscillator 30. According to another embodiment of the invention, a transducer 36 is provided in the air or atomizing fluid line 24 for modulating this fluid rather than the fuel. A similar result is achieved wherein the flame 12 produces electromagnetic radiation at a frequency which is substantially the same as that generated by oscillator 30. As will be set forth in greater detail hereinunder, a pilot light 32 may be provided which is used in starting up burner 10 and which generates a flame which can also be detected.

According to the invention, either electrodes or an antenna 34 is provided in the vicinity of flame 12 and pilot light 32. A signal applied to this antenna or electrode is amplified by a preamp 38 and supplied to a digital filter 40 which is also connected to oscillator 30 and produces an analog signal over line 42.

Digital filters are known which can be incorporated in the inventive environment and which are disclosed, in "Designers' Guide to: Digital Filters", D. J. Leon and S. C. Bass, EDN, Jan. 20, 1974, pages 30–75.

The output of digital filter 40 is supplied to a level comparator 44 which compares the electromagnetic signal intensity with a threshold value provided by flame threshold adjustment circuit 46. An output signal is provided by a level comparator 44 over line 48 which can be utilized to control either atomizing fluid regulator 20 or fuel control regulator 14 to any desired extent, for example to optimize the amplitude of the signal received from digital filter 40, which corresponds to maximum electromagnetic radiation and thus maximum flame temperature. In this way, almost stoichiometric burning of the fuel can be achieved for maximizing the efficiency of the burner.

Figure 2:
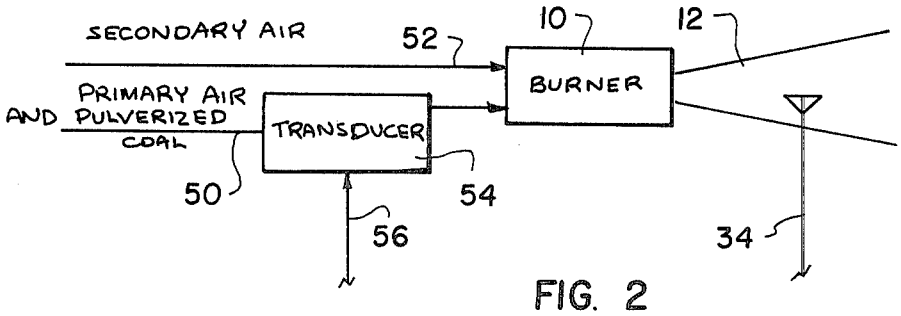
FIG. 2 is a block diagram showing an alternate arrangement for modulating the flame at a characteristic frequency.

Referring to FIG. 2 where corresponding elements are shown with corresponding numbers, in the case of a pulverized coal burner 10, primary air with pulverized coal is provided over a line 50 with secondary air being provided over a line 52. Transducer 54 is connected over line 56 to the power amplifier shown in FIG. 1, and functions to modulate the flow of primary air and pulverized coal to burner 10 which, accordingly, modulates the flame 12 to produce the electromagnetic signal.

Figure 3:
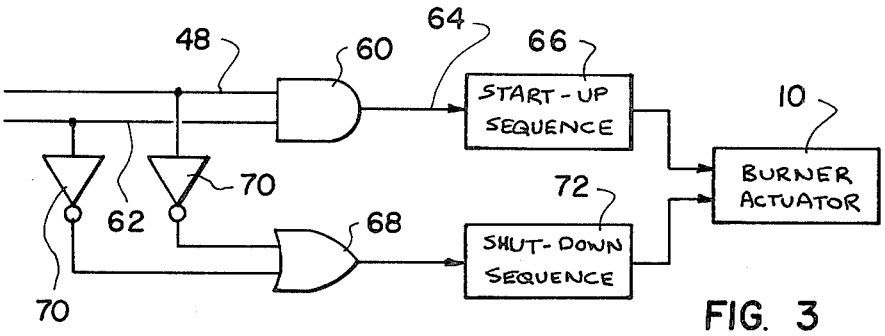
FIG. 3 is a block diagram illustrating an arrangement for controlling the start-up and shut-down sequence for a burner.

In FIG. 3, an arrangement is shown for facilitating start-up and shut-down of the burner. A flamon indication is provided over line 48 to an AND gate 60 which also receives a burner start-up request or instruction over line 62. With a positive signal received at both AND gate inputs, a positive output is provided at AND gate output 64 to a start-up sequence circuit 66 which starts up burner 10. Burner 10 includes a final actuator for this purpose which operates in known fashion.

For shut-down, an OR gate 68 is provided with two inputs that receive inverted signals from lines 48 and 62, as inverted by inverters 70. With either the absence of a flame or the non-occurrence of a burner start-up request signal, a shut-down sequence is initiated by a shut-down sequence circuit 72.

Figure 6:
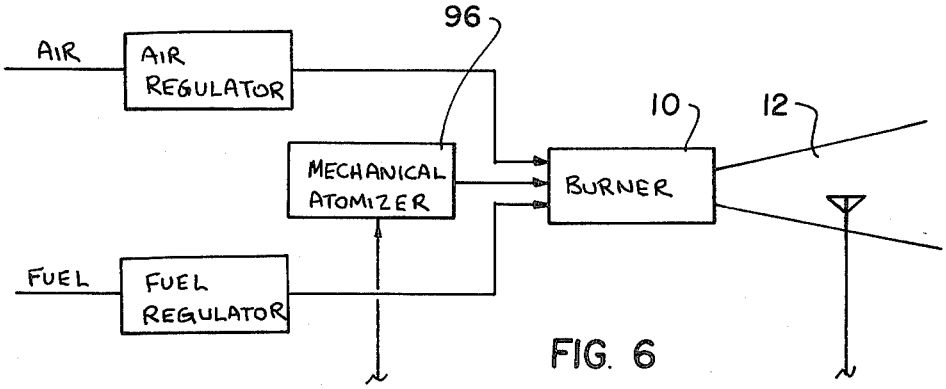
FIG. 6 is a block diagram similar to FIG. 2 showing a still further arrangement for modulating the burner flame.
Figure 4:
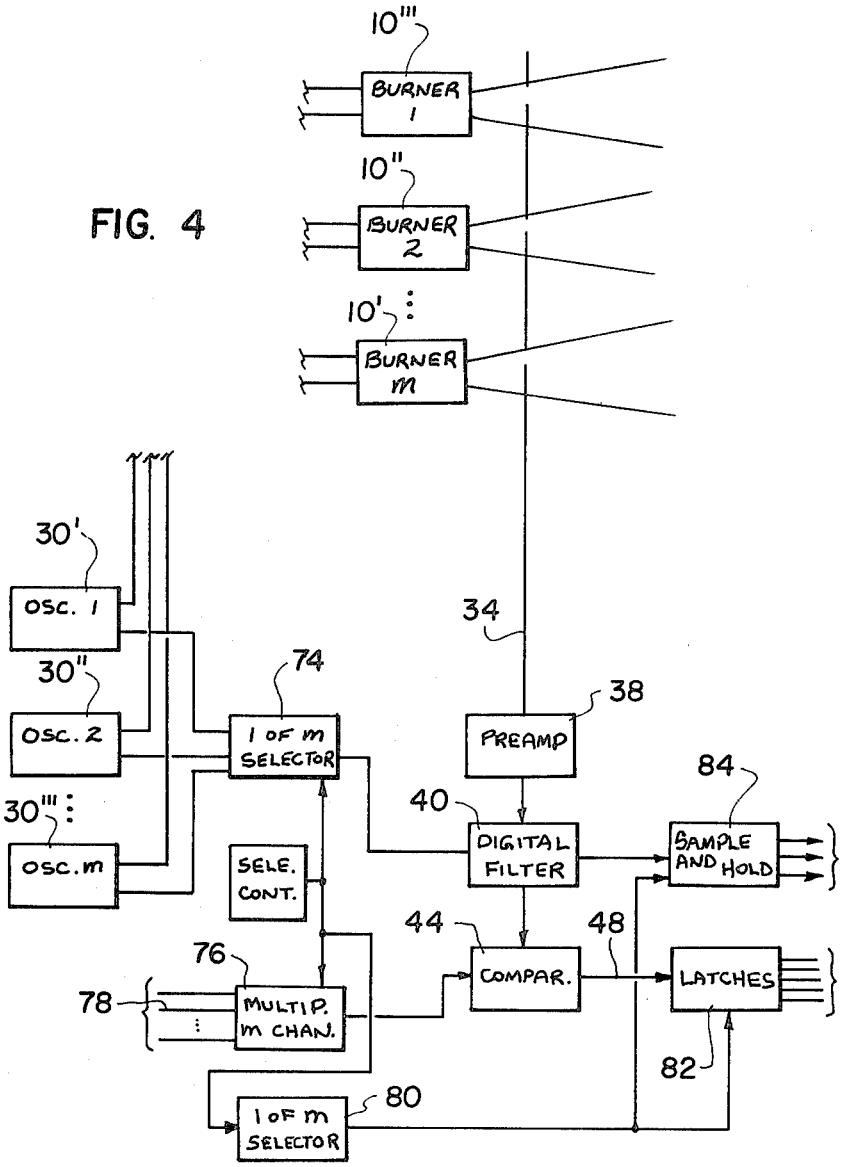
FIG. 4 is a block diagram showing an arrangement for monitoring several burner flames using a single detector.

FIG. 4 illustrates the use of a single detector arrangement 34, 38, 40 to detect the presence of several flames from several burners 10', 10'', and 10'''. The flames of the separate burners are modulated according to FIGS. 1, 2, or 6 (which will be described later) by separate oscillators 30', 30'' and 30'''. One oscillator is dedicated to each burner. Each of the oscillators has an output supplied to a selector 74 which is controlled by a multiplexer 76 with a plurality of inputs 78 for adjusting the threshold value for each burner separately. Multiplexer 76 is also connected to a second selector 80 which is connected, in turn, to a latch 82 for applying the correct control operation to the correct burner. As with the embodiments of FIGS. 1, 2 and 6, comparator 44 is utilized to establish a threshold value which is, in this case, controlled by multiplexer 76. Latch 82 is connected to signal line 48.

Digital filter 40 is also connected to a sample and hold circuit 84 which processes the analog signals for the various burners coming from digital filter 40.

Figure 5:
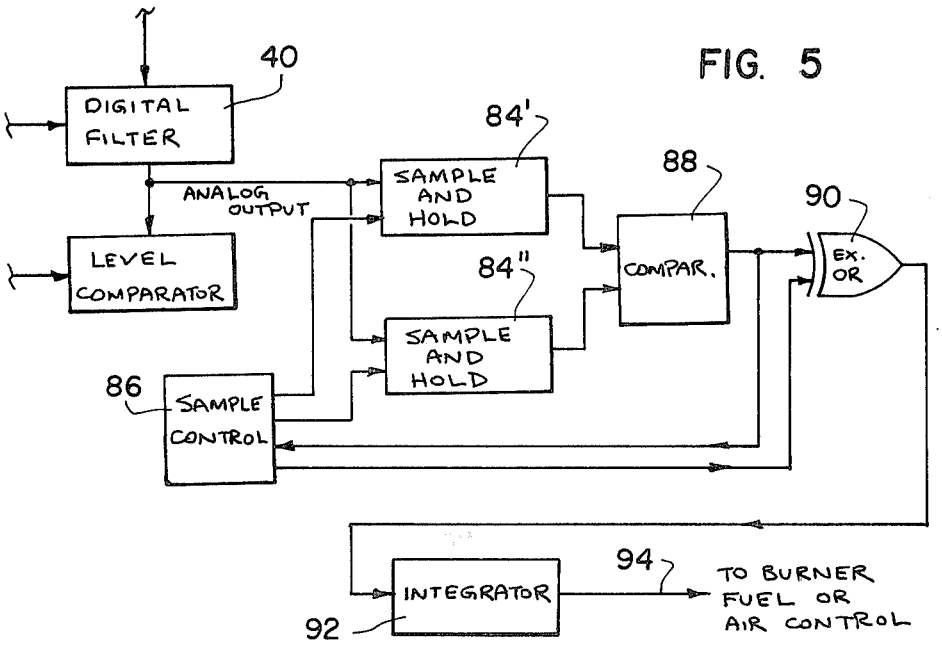
FIG. 5 is a block diagram showing an arrangement for optimizing the flame temperature and efficiency.

Referring now to FIG. 5, the output of digital filter 40 is provided to various sample and hold circuits 84' and 84'' which are controlled by a sample control 86. A comparator 88 is provided at the output of each sample and hold circuit which, in turn, supplies a signal to an exclusive OR gate 90. Exclusive OR gate 90 also receives a signal from sample control 86 and is connected to integrator 92 which, in turn, is connected over line 94 to a burner fuel or air control (not shown) for regulating the air or fuel flow and thus the flame intensity. The sample control 86 also receives a signal from the comparator 88.

The arrangement of FIG. 5 optimizes the electromagnetic signal and thus the flame temperature. The sample and hold circuits 84' and 84'' are alternately sampled, capturing sequential time samples of the analog signal received from the digital filter 40. The combination of the comparator 88 and the exclusive OR 90 yields an effective comparator with alternating polarity as controlled by the signal received from the sample control 86. This is required since alternate time samples are connected to alternate polarity comparator inputs.

When successive samples indicate a decreasing flame intensity the polarity of the exclusive inverter, which is acting in the controlled inventer mode, is changed. This changes the sense of the signal to the integrator 92 and demands a change in fuel or air flow that will increase the flame intensity.

In FIG. 6, it is shown that a mechanical atomizer 96 can be provided to regulate the flame 12, which mechanical atomizer is connected to the power amplifier of the arrangement shown in FIG. 1.

Figure 7:
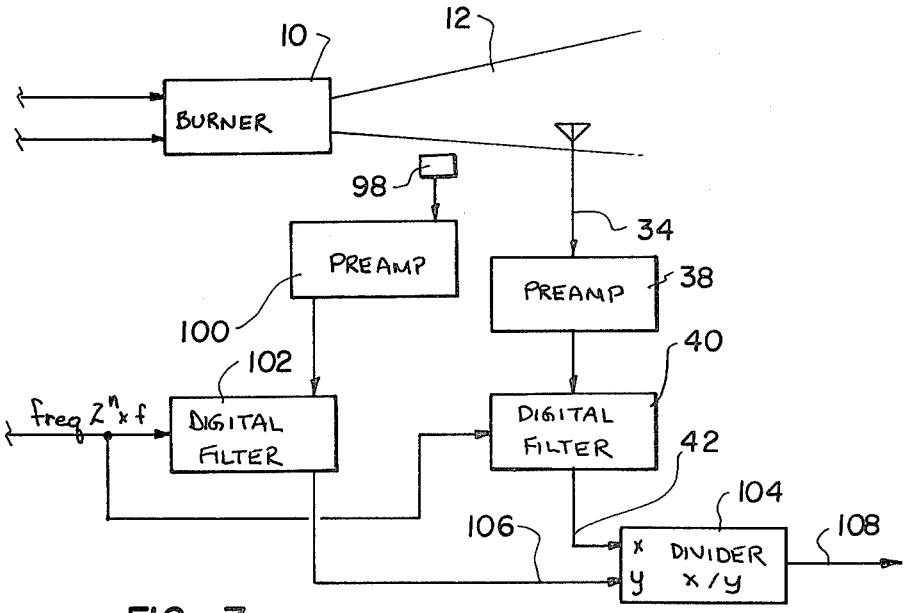
FIG. 7 is a block diagram showing an arrangement for comparing the electromagnetic radiation with the pressure wave signal from the flame.

As shown in FIG. 7, in addition to the electromagnetic signal detecting arrangement 34, 38, 40, a pressure wave pick-up or detector 98 is provided which may, for example, be a piezo-electric crystal. The signal from this pressure wave detector is provided to a preamp 100 which supplies a signal to a second digital filter 102 that is regulated at a frequency equal to $2^n \times f$ where f is equal to the characteristic frequency applied by the oscillator and n is an integer. Digital filter 40 is controlled by the same frequency-dependent value.

A signal proportional to the electromagnetic radiation is provided over line 42 to a divider circuit 104 and a signal proportional to the pressure wave intensity is provided over a line 106 to the divider 104. The output of divider 104 at 108 is thus proportional to the ratio X/Y, where X is the intensity of electromagnetic radiation and Y is the intensity of the pressure wave. This quantity can be used to obtain an absolute calibration for the burner 10 versus a relative calibration. An absolute calibration can be used for a particular burner of the system or for balancing as opposed to merely peaking an individual burner or a group of burners.

While specific embodiments of the invention have been shown and described in detail to illustrate the application of the principles of the invention, it will be understood that the invention may be embodied otherwise without departing from such principles.

What is claimed is:

1. A flame monitor for a first burner comprising:

a first oscillator for generating a signal at a characteristic frequency between 60 and 100,000 Hz;

a flame modulator connected to the first burner and to said first oscillator for modulating the flame at the characteristic frequency;

an electromagnetic signal detector associated with the first burner for sensing electromagnetic radiation from the flame;

an electronic bandpass filter connected to the detector for filtering out all but the electromagnetic signal at the characteristic frequency, which electromagnetic signal increases with increased flame temperature wherein said bandpass filter comprises a digital filter, said first oscillator having dual outputs, one for supplying a signal at the characteristic frequency to said flame modulator and the other for supplying a signal equal to $2^n \times f$ wherein n is an integer and f equals the characteristic frequency to said digital filter;

a level detector connected to said digital filter for determining the level of the electromagnetic radiation and for providing a stoichiometric combustion control function for said first burner corresponding to that level.

2. A flame monitor according to claim 1, wherein said level detector comprises a flame threshold adjustment circuit for establishing a threshold value for the electromagnetic signal and a level comparator for comparing the threshold value with the value of the electromagnetic signal from said digital filter, and level comparator and flame threshold adjustment circuit comprising said level detector.

3. A flame monitor according to claim 2, including an atomizing fluid regulator connected to the first burner for supplying atomizing fluid thereto, a fuel control regulator connected to the first burner for supplying fuel thereto and a transducer connected between either said atomizing fluid regulator or said fuel control regulator and said first burner for regulating the flow according to said characteristic frequency.

4. A flame monitor according to claim 2, wherein said flame modulator comprises a mechanical atomizer connected to the first burner and connected to said first oscillator for modulating atomization in the burner at said characteristic frequency.

5. A flame monitor according to claim 2, including a start-up sequence circuit connected to the first burner and a shut-down sequence circuit connected to the first burner for respectively starting up and shutting down operation of the first burner, the first burner including a pilot light which generates an electromagnetic signal detectable by said detector, an AND gate connected to said level comparator and to a burner start-up request line, said AND gate generating an output signal for starting up operation of the first burner and connected to said start-up sequence circuit when said level comparator indicates the presence of a pilot flame and said burner start-up request line indicates the presence of a request signal, an inverter connected to each of said level comparators and said burner start-up request line for inverting a signal therefrom and an OR gate having inputs connected to each of said inverters and an output connected to said shut-down sequence circuit for shutting down operation of said first burner upon the absence of a flame or a request signal.

6. A flame monitor according to claim 2, for monitoring the flame of at least one additional burner, including an additional oscillator connected to the additional burner, multiplexing means connected to said first oscillator and said additional oscillator, said multiplexer means connected to said digital filter for selectively applying the frequency of said first and said additional oscillator to said digital filter, said detector associated with said additional burner whereby a single detector is utilized to detect the presence of flame from said first and said additional burner.

7. A flame monitor according to claim 2, wherein said digital filter generates an analog output signal, at least two sample and hold circuits connected to said digital filter for receiving said analog signal, a comparator connected to an output of each sample and hold circuit, an exclusive OR gate connected to an output of said comparator, a sample control circuit connected to an input of said exclusive OR gate and to each of said sample and hold circuits, an an integrator connected to an output of said exclusive OR gate, said burner including control means for controlling one of fuel and air supplied to the burner, said integrator connected to said control means for increasing the flow of one of fuel and air until electromagnetic signal from the frame is maximized.

8. A flame monitor according to claim 2, including a pressure wave detector associated with the flame for detecting a pressure wave of the flame, a second digital filter connected to said pressure wave detector and circuit means connected to said firstmentioned and said additional digital filters for obtaining a ratio of intensities for the electromagnetic signal and a pressure wave signal.

* * * * *